US005854437A

United States Patent [19]

Merrick et al.

[11] Patent Number: 5,854,437

[45] Date of Patent: Dec. 29, 1998

[54] APPARATUS FOR TUNING ELECTRIC STRINGED MUSICAL INSTRUMENTS

[76] Inventors: Jeffrey A. Merrick, 210 Wesley Ct., Roseville, Calif. 95661; Keith F. Elliston, 1320 Woodside Glen Way, Sacramento, Calif. 95833

[21] Appl. No.: 635,618

[22] Filed: Apr. 22, 1996

Related U.S. Application Data

[63] Continuation-in-part of Ser. No. 503,825, Jul. 18, 1995.

[51] Int. Cl.[6] ..... G10H 3/00; G10H 3/12

[52] U.S. Cl. ..... 84/454; 84/723; 84/725; 84/DIG. 18

[58] Field of Search ..... 84/454, DIG. 18, 84/723–726, 743

[56] References Cited

U.S. PATENT DOCUMENTS

| | | | |
|---|---|---|---|
| 4,018,124 | 4/1977 | Rosado . | |
| 4,041,832 | 8/1977 | Risch . | |
| 4,951,545 | 8/1990 | Yoshida | 84/646 |
| 5,029,511 | 7/1991 | Rosendahl | 84/743 |
| 5,388,496 | 2/1995 | Miller et al. . | |
| 5,396,827 | 3/1995 | Miller et al. . | |
| 5,427,011 | 6/1995 | Steinberger . | |
| 5,637,820 | 6/1997 | Wittman | 84/454 |

OTHER PUBLICATIONS

Sabine, Inc., STL–12 Stealth Tuner, Oct. 3, 1994, product info sheet STL–12CUT.

Sabine, Inc., AX–800 guitar mount AutoTuner, Mar. 11, 1994, product info sheet AXTSG.

*Primary Examiner*—William M. Shoop, Jr.
*Assistant Examiner*—Marlon T. Fletcher
*Attorney, Agent, or Firm*—Thomas R. Lampe

[57] ABSTRACT

Tuner apparatus for tuning an electric stringed musical instrument includes a pickup in a pickup cavity formed in the instrument. A pickup ring extends around the pickup and includes a pickup ring wall forming a visual display panel. Tuner circuitry includes a flexible printed circuit strip adjacent to the pickup and positioned in the pickup cavity. The flexible printed circuit strip is electrically connected to a light module positioned next to the visual display panel of the pickup ring.

17 Claims, 2 Drawing Sheets

APPARATUS FOR TUNING ELECTRIC STRINGED MUSICAL INSTRUMENTS

This application is a continuation-in-part of co-pending U.S. application Ser. No. 08/503,825 filed Jul. 18, 1995.

TECHNICAL FIELD

This invention relates to apparatus for use when tuning electric stringed musical instruments, for example electric guitars. More particularly, the apparatus of the present invention relates to a tuner which provides a visual display during the tuning operation to facilitate tuning.

BACKGROUND ART

It is a truism that stringed musical instruments, such as electric guitars, must be maintained in tune to operate properly. In the past, tuning was accomplished strictly by ear and not always accurately, particularly when the person doing the tuning was not blessed with the highly developed auditory faculties required to accomplish such task.

A relatively recent development is the electronic tuner which enables a person to tune his or her guitar or other musical instrument without having to depend upon the human ear. A number of different types of electronic tuners are currently available on the market, including external tuners which are disposed at or on the exterior of the instrument. External tuners have a number of deficiencies, not the least of which is the fact that the tuners themselves may constitute eyesores (or at least detract from the aesthetic appearance of the instruments with which they are associated). Also, installation of such tuners can be a daunting task.

Electronic tuners built into electric guitars have been devised. U.S. Pat. No. 4,018,124, issued Apr. 19, 1977, for example, illustrates an electronic guitar tuner for a standard six string electric guitar which includes a pickup, a master crystal oscillator, and a tone generator for each string of the guitar. The pickup feeds a frequency comparator for each string of the guitar and each frequency comparator is fed by a separate tone generator.

A light emitting diode is positioned under each of the strings of the guitar and is connected between the frequency comparator and a source of electricity, either battery or transformer. When the frequency of the individual tone generator and the frequency of the string match, the frequency comparator will complete a circuit through the light emitting diode so that the light emitting diode indicates that the individual string is properly tuned. When the string is out of tune it is adjusted in the normal fashion until the light emitting diode associated therewith is energized.

The approach disclosed in U.S. Pat. No. 4,018,124 can not be utilized on preexisting guitar structures without considerable guitar modification taking place. Furthermore, the structural components of the tuner detract from the aesthetic appearance of the stringed musical instrument. Since the light emitting diodes employed are disposed under the strings, they are not readily observable by the player, thus requiring the use of relatively large tuning indicators.

Another prior art approach has been to employ a built-in tuner module with a remote light emitting diode tuning indicator mounted elsewhere on the guitar. Some customizing of the guitar must still be carried out to utilize a built-in tuner of this nature. Typically, routing, drilling or other approaches to working or modifying the guitar body must be employed and the value of the stringed musical instrument itself can be diminished by carrying out such steps.

Furthermore, use of a remote LED tuning indicator can be highly detrimental to the appearance of the guitar. The indicator itself must be glued or otherwise attached to the guitar with the LED housing in plain view, affecting the overall appearance of the guitar. Considerable skill and ingenuity may be required to attain even this degree of visual impact, particularly when one wishes to hide or cover other structural components of the tuner such as the cable interconnecting the main portion of the tuner to the LED tuning indicator module.

In addition to U.S. Pat. No. 4,018,124 referenced above, applicant is aware of the following U.S. Pat. which are believed to represent the current state of the prior art in this field: U.S. Pat. No. 5,396,827, issued Mar. 14, 1995, U.S. Pat. No. 5,388,496, issued Feb. 14, 1995, U.S. Pat. No. 5,427,011, issued Jun. 27, 1995, and U.S. Pat. No. 4,041,832, issued Aug. 16, 1977. Additional prior art devices are the STL-12 Stealth Tuner made available by Sabine, Inc. of Gainesville, Fla. and described in Sabine product information sheet STL-12CUT dated Oct. 3, 1994 and the AX-800 guitar mount AutoTuner, also made available by Sabine, Inc., described in Sabine product information sheet AXTSG, dated Mar. 11, 1994.

DISCLOSURE OF INVENTION

The present invention relates to electronic tuning apparatus which is compact in construction and does not affect the appearance of the instrument with which it is utilized and yet provides a visual display panel readily observable by the individual playing or tuning the instrument. No structural modification of the instrument need be made to enable installation, nor are special tools required for such purpose.

The apparatus of the present invention includes a pickup, such as a humbucker pickup, positionable in a pickup cavity of a stringed musical instrument.

A pickup ring defines a pickup ring interior and extends substantially around the pickup and includes at least one pickup ring wall comprising a visual display panel.

Tuner circuit means is located adjacent to the pickup within the confines or interior of the pickup ring and includes a plurality of lights disposed adjacent to the visual display panel and observable from a location external of the pickup ring.

When practicing the present invention, a pickup ring constructed in accordance with the teachings of the present invention replaces a standard humbucker ring or other pickup ring. The pickup ring side wall of a pickup ring constructed in accordance with the teachings of the present invention defines a plurality of spaced openings, each light of the plurality of lights of the tuner circuit means being observable through a spaced opening defined by the pickup ring side wall.

The tuner circuit means includes a flexible printed circuit strip extending along and in back of the pickup when the pickup is in the pickup cavity of a stringed musical instrument.

Other features, advantages, and objects of the present invention will become apparent with reference to the following description and accompanying drawings.

BEST MODE FOR CARRYING OUT THE INVENTION

Figure 1:
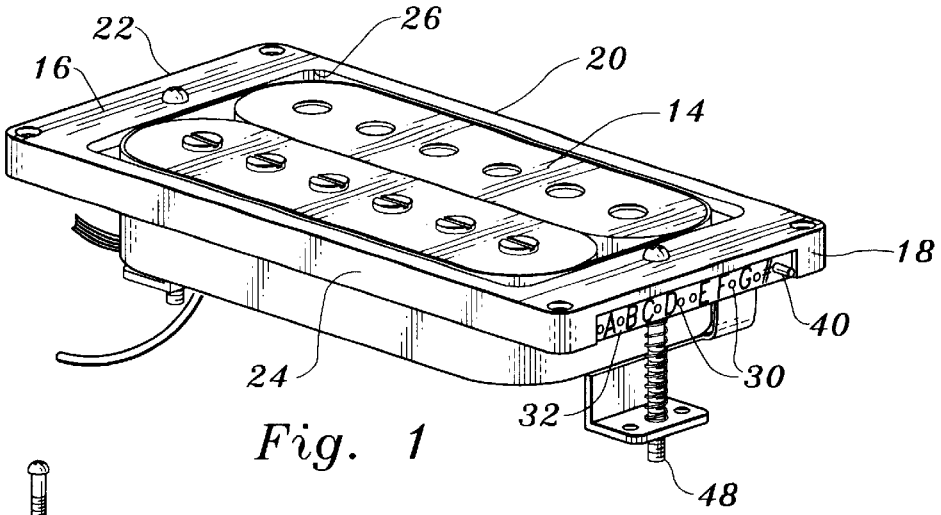
FIG. 1 is a perspective view of apparatus constructed in accordance with the teachings of the present invention.
Figure 2:
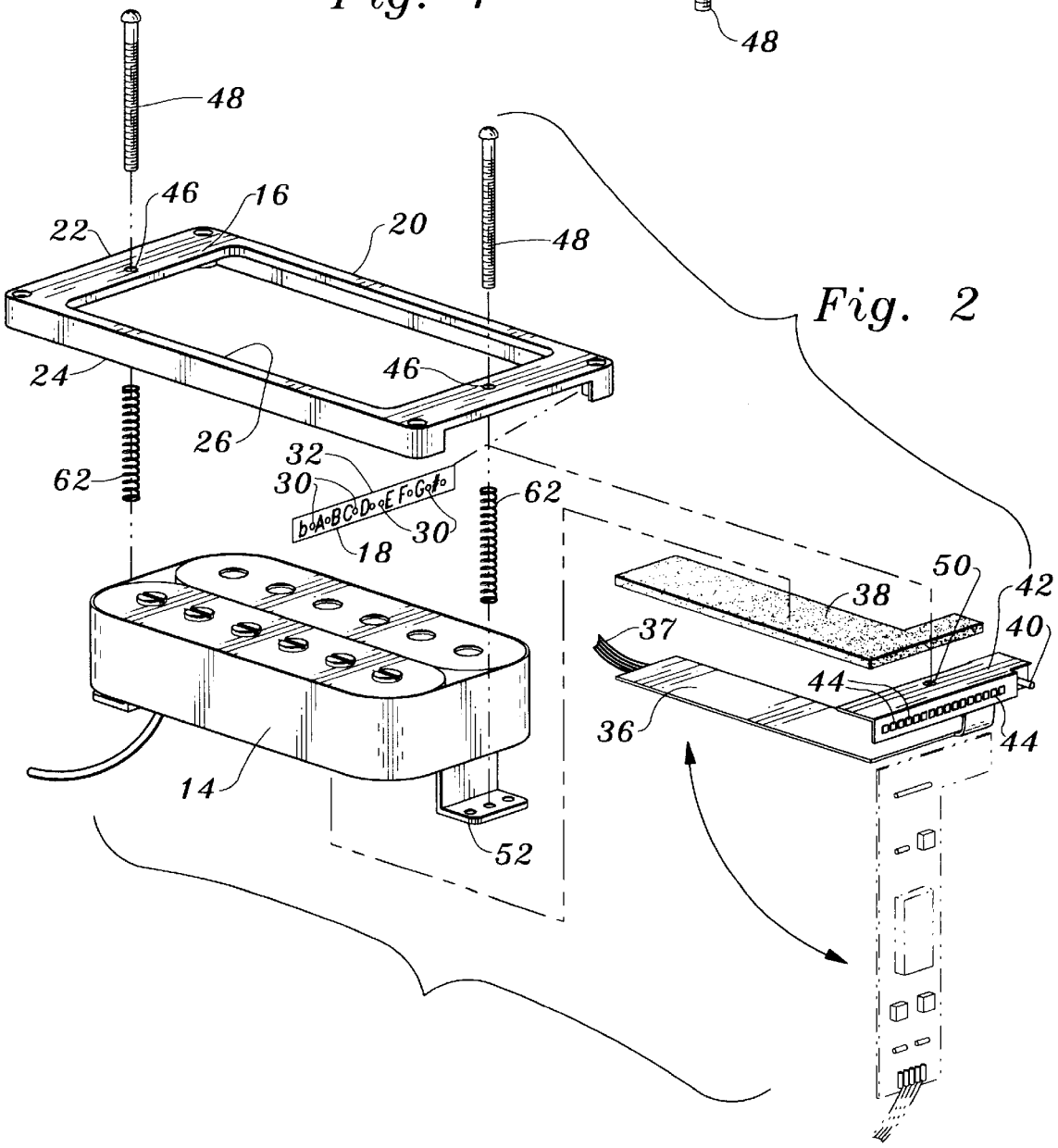
FIG. 2 is an exploded, perspective view of the apparatus.
Figure 3:
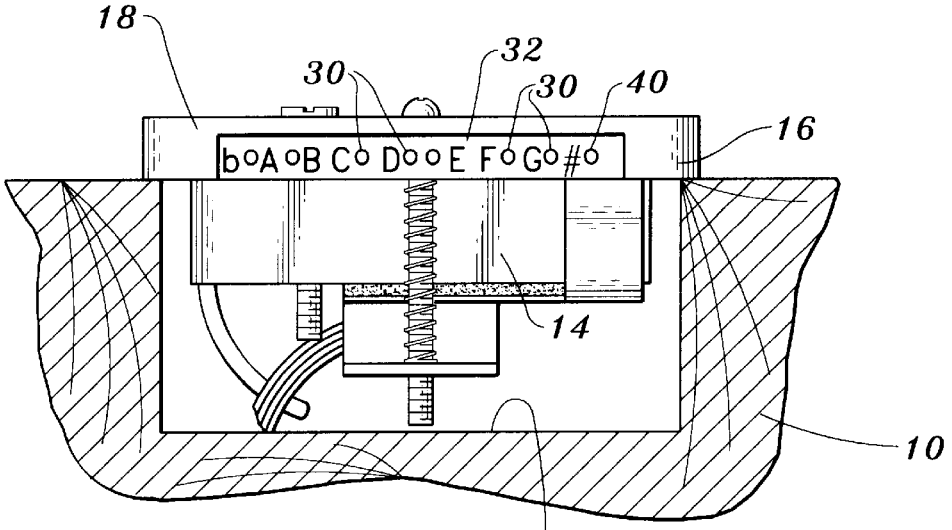
FIG. 3 is a front view of the apparatus installed in a humbucker pickup cavity of a guitar, a portion of the guitar illustrated in cross-section.
Figure 4:
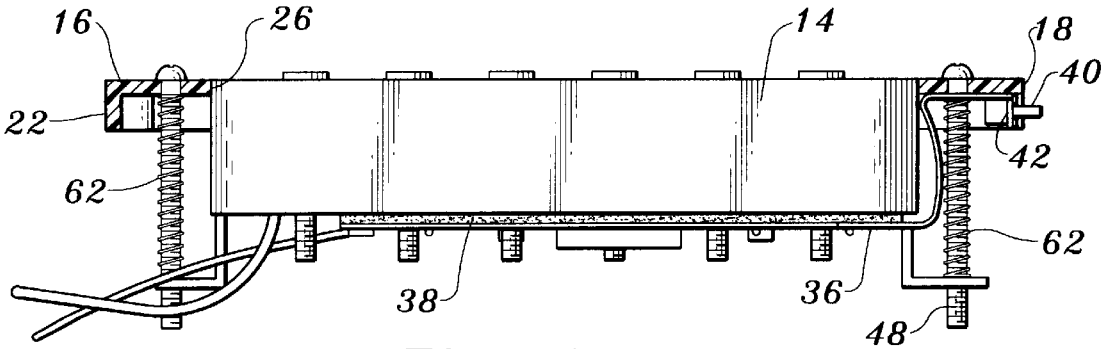
FIG. 4 is a side view of the apparatus, a portion of the pickup ring employed in the apparatus being shown in cross-section.
Figure 5:
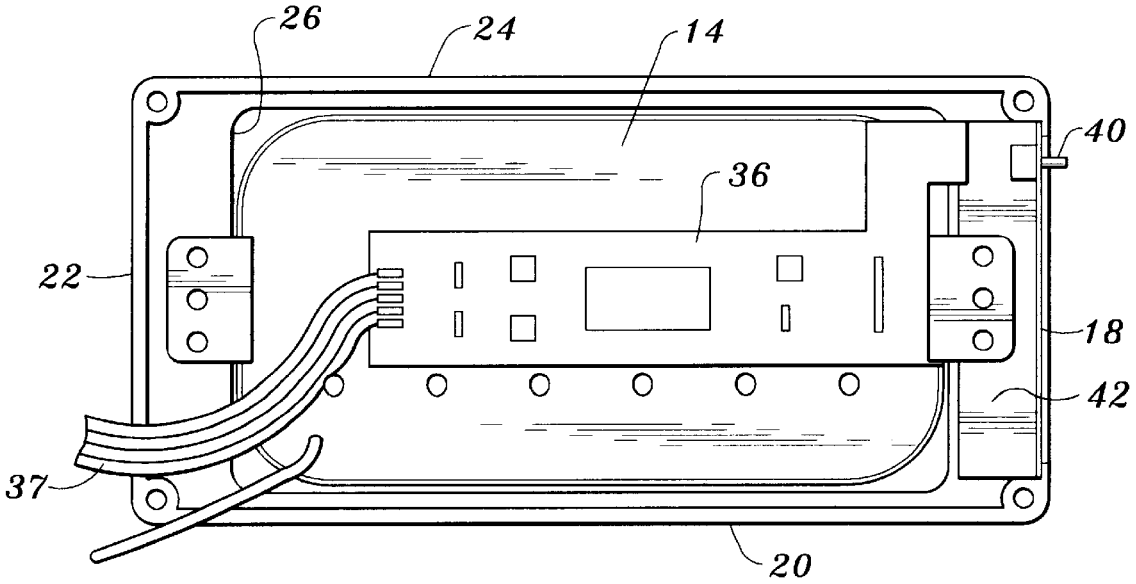
FIG. 5 is a bottom view of the apparatus.

Referring to FIG. 3 of the drawings, a portion of a stringed musical instrument in the form of an electric guitar 10 is illustrated. A pickup cavity 12 is formed in the guitar. The cavity, conventional in many electric guitar constructions, is for the purpose of accommodating a standard electric guitar pickup, in this particular instance a type of pickup known in the electric guitar art as a humbucker or humbucker pickup. A humbucker pickup 14 of conventional construction is illustrated as positioned in the pickup cavity.

It is conventional to employ a pickup ring in conjunction with a humbucker or other types of pickup, the ring extending around the pickup. The ring maintains separation between the guitar strings and the pickup.

Apparatus constructed in accordance with the teachings of the present invention also includes a pickup ring, in this instance humbucker ring 16; however, humbucker ring 16 is of a unique construction.

Humbucker ring 16 is suitably formed from molded plastic material, although other materials may be employed in its construction. Humbucker ring 16 has four interconnected side walls 18, 20, 22 and 24, the walls defining a confined space or ring interior 26.

Humbucker pickup ring side wall 18 is in the form of a visual display panel and defines a plurality of spaced openings 30. Openings 30 may literally be open or some or all of them may be covered with translucent material.

In the arrangement illustrated, the openings are in a panel element 32 secured in place as by adhesive or the like to the remainder of side wall 18. Alternatively, the side wall 18 may be of one piece construction.

Some of the openings are in the form of alphabetical indicia indicating musical notes. Some of the openings are preferably utilized to designate sharp or flat notes. Use of visual note indicators and sharp/flat indicators per se on guitar tuners is known, as evidenced by the prior art referenced above. As previously indicated, such displays conventionally are incorporated in the tuner structure itself or in a separate remote tuning indicator module connected to the primary tuner module by electric wiring or cable and separately secured to the outer surface of the guitar or other musical instrument.

Tuner circuit means is located adjacent to the pickup 14 within the confines or interior of the pickup ring 16. The tuner circuit means includes a flexible printed circuit strip 36 which has imprinted thereon and/or applied thereto the components of standard tuner circuitry, for example, the circuitry components disclosed in U.S. Pat. No. 4,018,124, referenced above.

The precise nature of the tuner circuitry and the cooperative relationship existing between the circuit components are not part of the present invention. Such circuitry may vary in accordance with the end results desired and information to be provided to the individual tuning the electric guitar or other electric stringed musical instrument to which the teachings of the present invention are applied. An electric cable 37 extends from the strip 36 and is connected at the other end thereof to the electric guitar's circuitry (not shown) so that the guitar output signals are fed to the tuning circuit's input. Also, the cable can be employed to connect the tuning circuit to the electric guitar battery power supply (not shown).

Flexible printed circuit strip 36 is secured to the back of the pickup by a double faced adhesive tape 38. The printed circuit strip extends along and in back of the pickup 14 within the pickup cavity 12. Flexible printed circuit strip 36 is connected at one end thereof to a light module 42 including a plurality of light emitting diodes 44 linearly disposed relative to each other. Placement of the light emitting diodes 44 corresponds to placement of the openings 30 in pickup ring 16.

Flexible printed circuit strip 36 flexes and curves to extend in an outwardly direction between light module 42 and the pickup, the flexible nature of the printed circuit strip allowing the strip to be accommodated within the restricted space of cavity 12 in back of and alongside the pickup. Thus, no routing or other working of the guitar is required to mount the tuner. An on/off button 40 projects from module 42 and is operatively associated with the tuner circuitry to turn it on or off.

In the arrangement illustrated, pickup ring 16 has openings 46 therein which accommodate metal screws 48. One of the screws extends through an opening 50 in light module 42 into threaded engagement with an outwardly projecting flange 52 of the pickup.

The other screw 48 connects the other end of the pickup ring to the other end of the pickup. Thus a unitary assemblage is formed. Holes 60 at the corners of the humbucker ring 16 accommodate screws or other fasteners (not shown) utilized to secure the assemblage to the guitar. Springs 62 permit adjustment between the pickup and pickup ring while maintaining the pickup (and attached printed circuit strip) in supported condition. The flexing of the flexible printed circuit strip readily permits such adjustment.

We claim:

1. In combination with an electric guitar having a pickup cavity formed therein and a pickup permanently located in said pickup cavity, apparatus for tuning said electric guitar, said apparatus including;

a pickup ring connected to the electric guitar and defining a pickup ring interior in communication with the pickup cavity of the electric guitar, said pickup ring having a plurality of interconnected pickup ring walls and extending substantially around said pickup, at least one of said pickup ring walls comprising a visual display panel; and tuner circuit means located in the pickup cavity of the electric guitar adjacent to said pickup and within the pickup ring interior of said pickup ring, said tuner circuit means including visual display means positioned adjacent to said visual display panel and observable at said visual display panel from a location external of said pickup ring.

2. The combination according to claim 1 wherein said visual display panel comprises a pickup ring side wall, said pickup ring side wall defining a plurality of openings, said visual display means comprising a plurality of lights and each light of said plurality of lights being observable through an opening defined by said visual display panel.

3. The combination according to claim 1 wherein said pickup has a front and a back and wherein said tuner circuit means additionally includes a printed circuit extending along and in back of said pickup.

4. The combination according to claim 3 wherein said printed circuit at least partially comprises a flexible printed circuit strip.

5. The combination according to claim 4 additionally comprising securement means securing said flexible printed circuit strip to said pickup.

6. The combination according to claim 5 wherein said securement means comprises adhesive securement means adhesively securing said flexible printed circuit strip to the back of said pickup.

7. The combination according to claim 2 wherein said plurality of lights comprise light emitting diodes.

8. The combination according to claim 2 additionally comprising indicia on said visual display panel adjacent to said plurality of lights to identify said lights.

9. In combination with an electric guitar having a pickup cavity formed therein and a pickup permanently located in said pickup cavity, apparatus for tuning said electric guitar, said apparatus including:

a pickup ring defining a pickup ring interior, said pickup ring positioned on said electric guitar and extending substantially around said pickup, and said pickup ring including at least one pickup ring wall comprising a visual display panel projecting outwardly from said electric guitar; and tuner circuit means located adjacent to said pickup within the pickup ring interior of said pickup ring and within the pickup cavity of said electric stringed musical instrument, said tuner circuit means including visual display means located adjacent to said visual display panel and within said pickup ring interior observable at said visual display panel from a location external of said pickup ring.

10. The combination according to claim 9 wherein said pickup ring wall comprises a pickup ring side wall, said pickup ring side wall defining a plurality of openings, said visual display means comprising a plurality of lights and each light of said plurality of lights being observable through an opening defined by said pickup ring side wall.

11. The combination according to claim 9 wherein said pickup has a front and a back and wherein said tuner circuit means additionally includes a printed circuit extending along and in back of said pickup in the pickup cavity of said electric guitar.

12. The combination according to claim 11 wherein said printed circuit at least partially comprises a flexible printed circuit strip.

13. The combination according to claim 11 additionally comprising securement means securing said flexible printed circuit strip to said pickup.

14. The combination according to claim 13 wherein said securement means comprises adhesive securement means adhesively securing said flexible printed circuit strip to the back of said pickup.

15. The combination according to claim 10 wherein said plurality of lights comprise light emitting diodes.

16. The combination according to claim 10 additionally comprising indicia on said visual display panel adjacent to said plurality of lights to identify said lights to a player of said electric guitar.

17. Apparatus for tuning an electric guitar having a pickup cavity and a pickup permanently located in said pickup cavity, said apparatus comprising, in combination:

a pickup ring for attachment to an electric guitar having a pickup cavity and a pickup permanently located in said pickup cavity, said pickup ring including a plurality of pickup ring walls defining a pickup ring interior, at least one of said pickup ring walls comprising a visual display panel;

attachment means for attaching said pickup ring to said electric guitar with the pickup ring interior in communication with said pickup cavity and said pickup ring extending about said pickup cavity; and tuner means including a light source operatively associated with said pickup ring for providing a visual display at said visual display panel, said tuner means positioned in said pickup cavity adjacent to said pickup and said light source being disposed within said pickup ring interior and adjacent to said visual display panel when said pickup ring is attached to said electric guitar by said attachment means.

* * * * *